US010640185B2

(12) United States Patent
Jacobs

(10) Patent No.: US 10,640,185 B2
(45) Date of Patent: May 5, 2020

(54) ENVIRONMENTAL PROTECTION GARMENT

(71) Applicant: Africa Jacobs, Humble, TX (US)

(72) Inventor: Africa Jacobs, Humble, TX (US)

( * ) Notice: Subject to any disclaimer, the term of this patent is extended or adjusted under 35 U.S.C. 154(b) by 0 days.

(21) Appl. No.: 15/983,228

(22) Filed: May 18, 2018

(65) Prior Publication Data

US 2019/0351984 A1 Nov. 21, 2019

(51) Int. Cl.

| | |
|---|---|
| ***A41D 13/02*** | (2006.01) |
| ***B63C 9/105*** | (2006.01) |
| ***A41D 13/012*** | (2006.01) |
| ***B63C 9/08*** | (2006.01) |
| *B63C 9/00* | (2006.01) |

(52) U.S. Cl.

CPC ..... *B63C 9/1055* (2013.01); *A41D 13/0125* (2013.01); *B63C 9/081* (2013.01); *A41D 2600/10* (2013.01); *B63C 2009/007* (2013.01); *B63C 2009/0017* (2013.01)

(58) Field of Classification Search

CPC ..... B63C 9/20; B63C 9/155; B63C 9/1255; B63C 9/1055; A41D 7/00; A41D 7/001; A41D 7/003; A41D 13/0125

See application file for complete search history.

(56) References Cited

U.S. PATENT DOCUMENTS

| | | | | |
|---|---|---|---|---|
| 1,819,901 | A * | 8/1931 | Lehmann | B63C 9/1255 137/223 |
| D320,475 | S | 10/1991 | Jeter, Jr. | |
| 7,351,126 | B2 | 4/2008 | Turner | |
| 7,699,679 | B2 | 4/2010 | Lahyani | |
| 8,231,421 | B1 | 7/2012 | Hubbard | |
| 8,763,603 | B2 | 7/2014 | Raisch | |
| 9,381,982 | B1 | 7/2016 | Sumpter | |
| 9,637,209 | B1 * | 5/2017 | Brown | B63C 9/20 |
| 9,963,210 | B1 * | 5/2018 | Ebot | A41D 13/0051 |
| 2004/0157514 | A1 | 8/2004 | Courtney | |
| 2007/0294797 | A1 * | 12/2007 | Furgerson | A41D 13/012 2/2.15 |
| 2015/0360759 | A1 | 12/2015 | Ashard | |
| 2016/0355245 | A1 * | 12/2016 | Schechter | B63C 11/08 |
| 2018/0057126 | A1 * | 3/2018 | Chen | B63C 9/11 |

* cited by examiner

*Primary Examiner* — Andrew Polay

(57) ABSTRACT

An environmental protection garment for use during water activities includes a wetsuit. A plurality of bladders, a receiver, a transmitter, and a controller are coupled to the wetsuit. An inflation unit coupled to the wetsuit and fluidically coupled to the plurality of bladders. The receiver is global position system enabled. The controller is operationally coupled to the inflation unit, the receiver, and the transmitter. The controller is positioned to selectively actuate the inflation unit to inflate the bladders to increase a buoyancy of a user. The controller is positioned to selectively actuate the receiver to receive location coordinates and the transmitter to transmit the location coordinates and a distress signal.

9 Claims, 6 Drawing Sheets

FIG. 4

ENVIRONMENTAL PROTECTION GARMENT

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to garments and more particularly pertains to a new garment for use during water activities.

BRIEF SUMMARY OF THE INVENTION

An embodiment of the disclosure meets the needs presented above by generally comprising a wetsuit. A plurality of bladders, a receiver, a transmitter, and a controller are coupled to the wetsuit. An inflation unit coupled to the wetsuit and fluidically coupled to the plurality of bladders. The receiver is global position system enabled. The controller is operationally coupled to the inflation unit, the receiver, and the transmitter. The controller is positioned to selectively actuate the inflation unit to inflate the bladders to increase a buoyancy of a user. The controller is positioned to selectively actuate the receiver to receive location coordinates and the transmitter to transmit the location coordinates and a distress signal.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figures 1, 4:
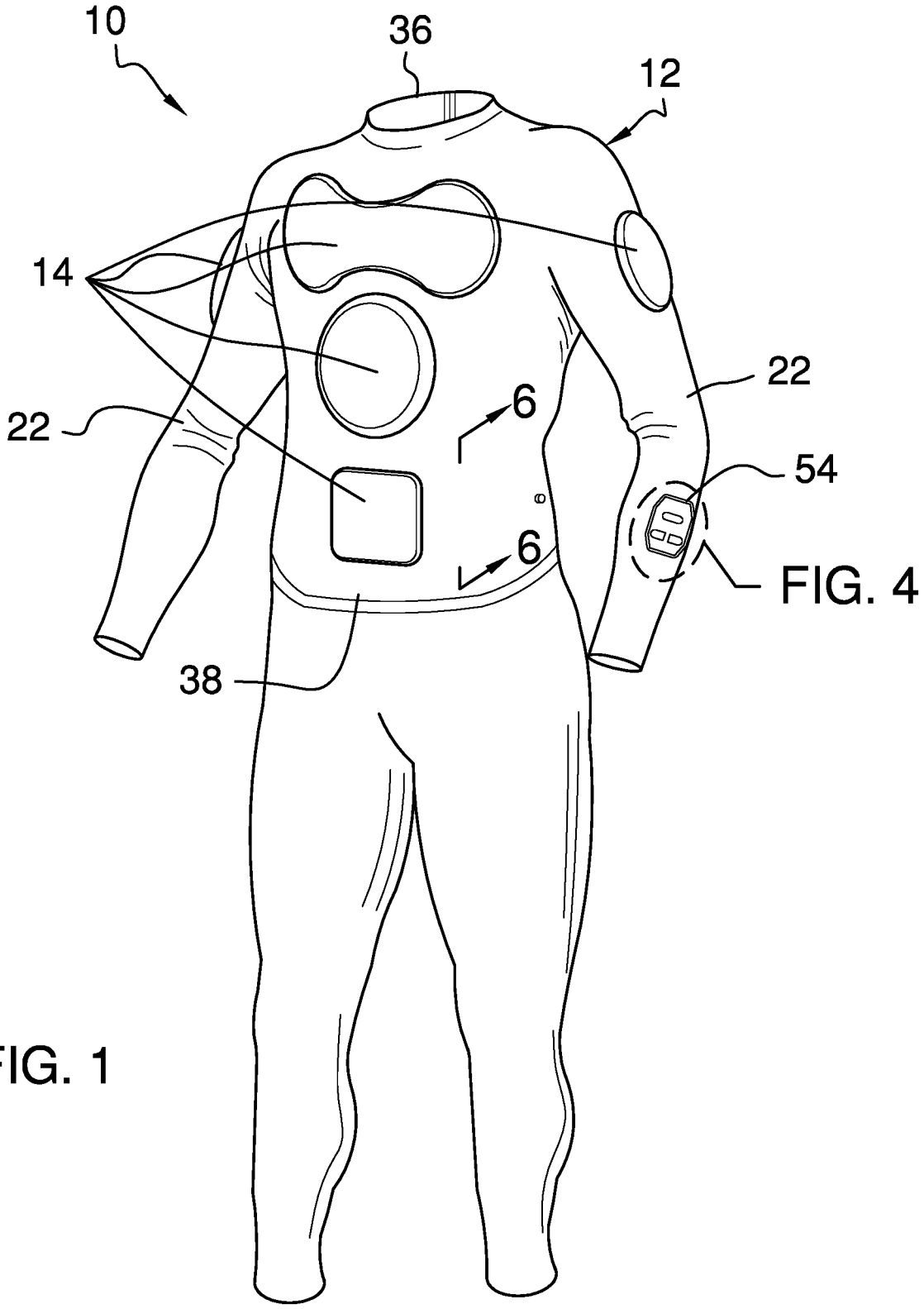
FIG. 1 is an isometric perspective view of an environmental protection garment according to an embodiment of the disclosure.
FIG. 4 is a detail view of an embodiment of the disclosure.

With reference now to the drawings, and in particular to FIGS. 1 through 6 thereof, a new garment embodying the principles and concepts of an embodiment of the disclosure and generally designated by the reference numeral 10 will be described.

As best illustrated in FIGS. 1 through 6, the environmental protection garment 10 generally comprises a wetsuit 12. A plurality of bladders 14 is coupled to the wetsuit 12. The plurality of bladder comprises a pair of arm bladders 16, a plurality of front bladders 18, and a plurality of rear bladders 20.

Figure 2:
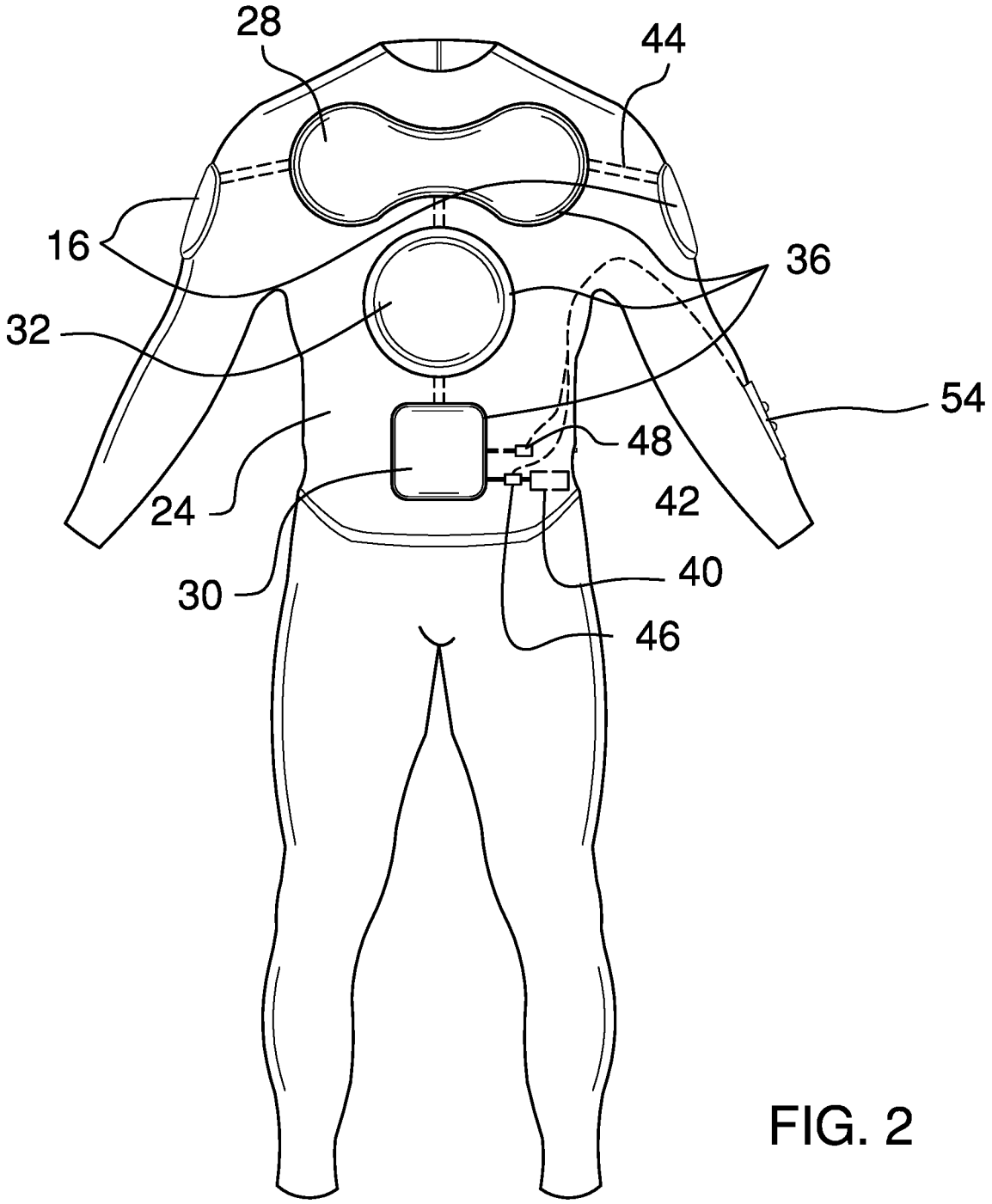
FIG. 2 is a front view of an embodiment of the disclosure.
Figure 3:
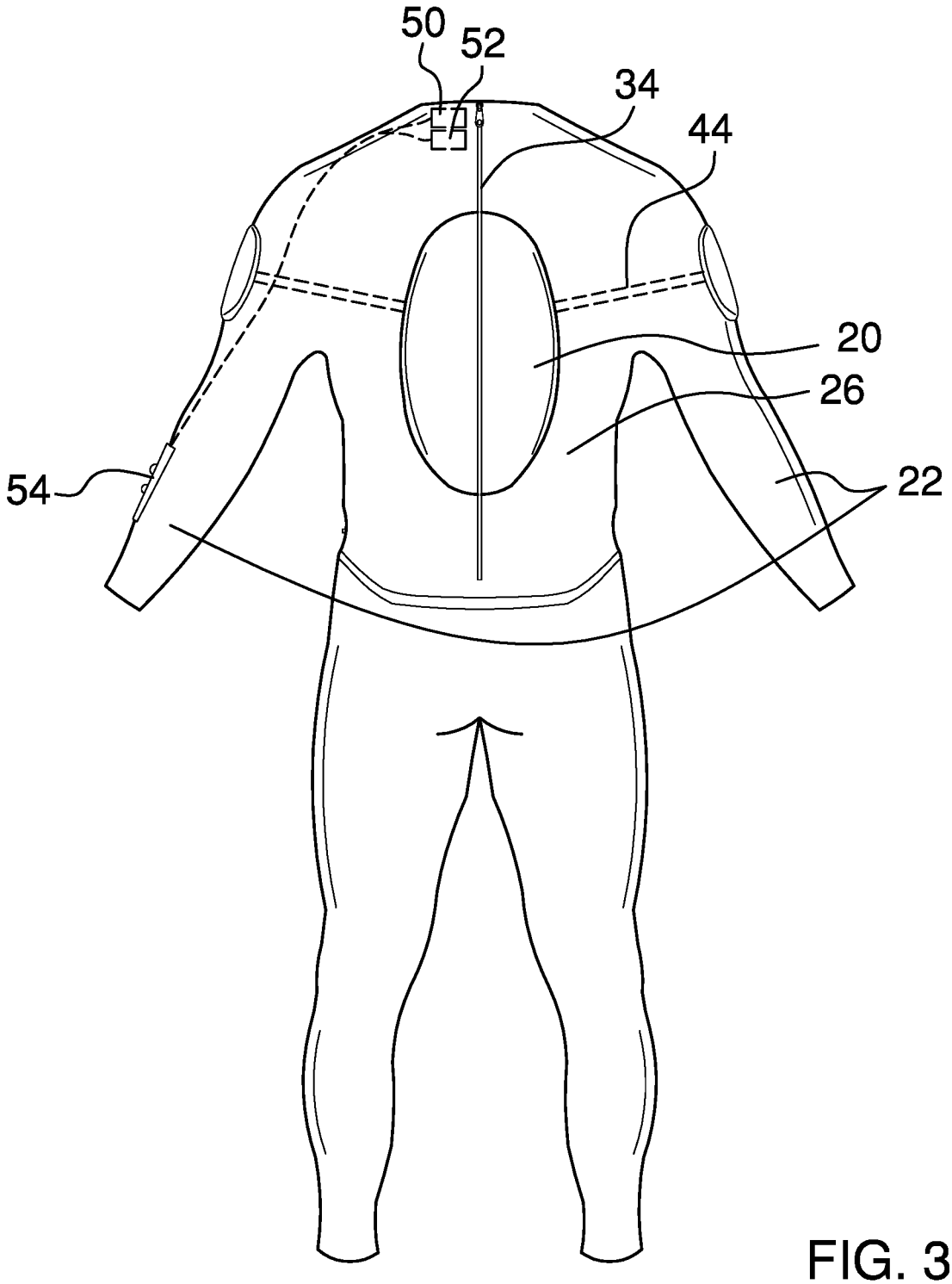
FIG. 3 is a back view of an embodiment of the disclosure.
Figure 4:
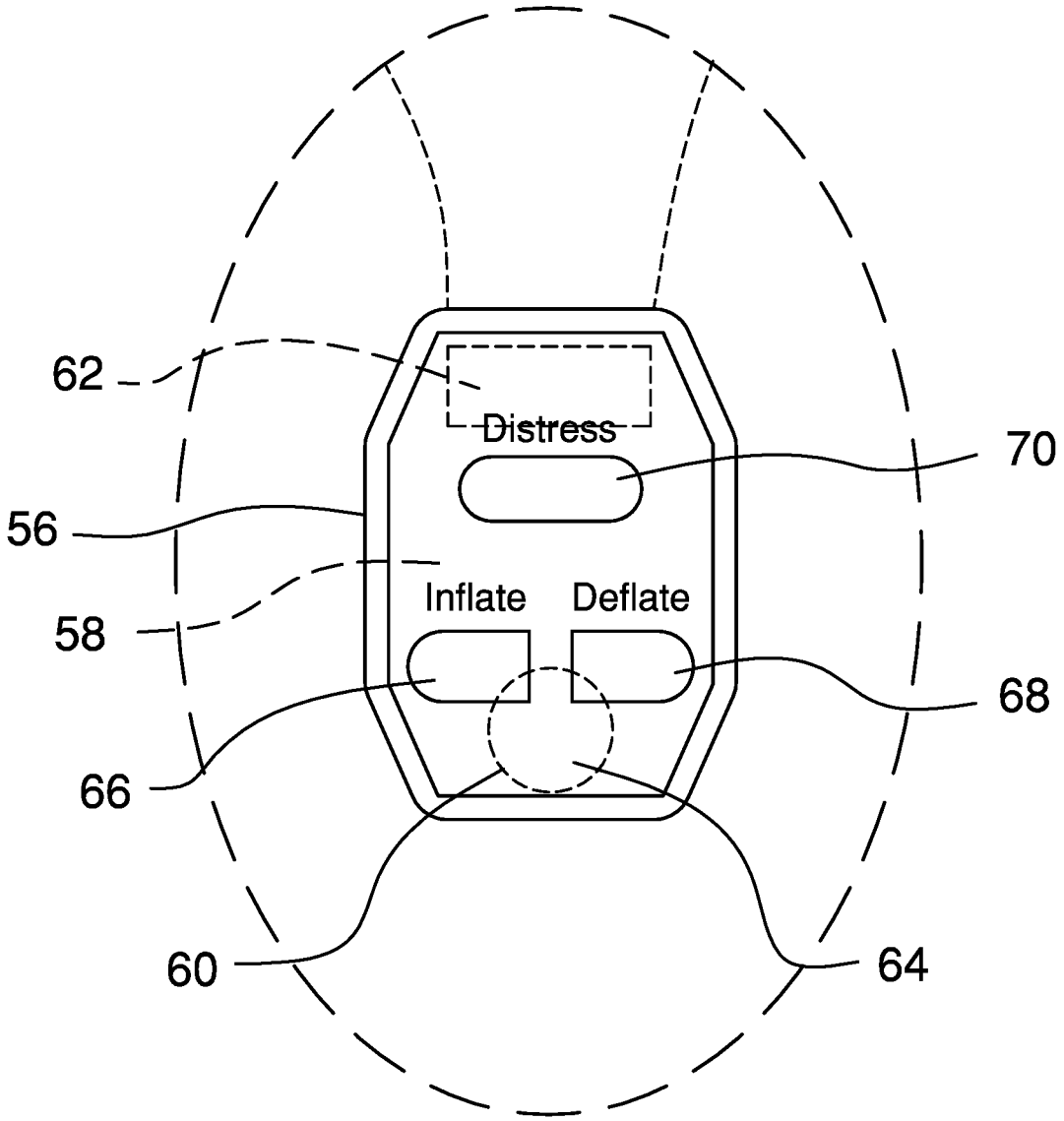
Figure 5:
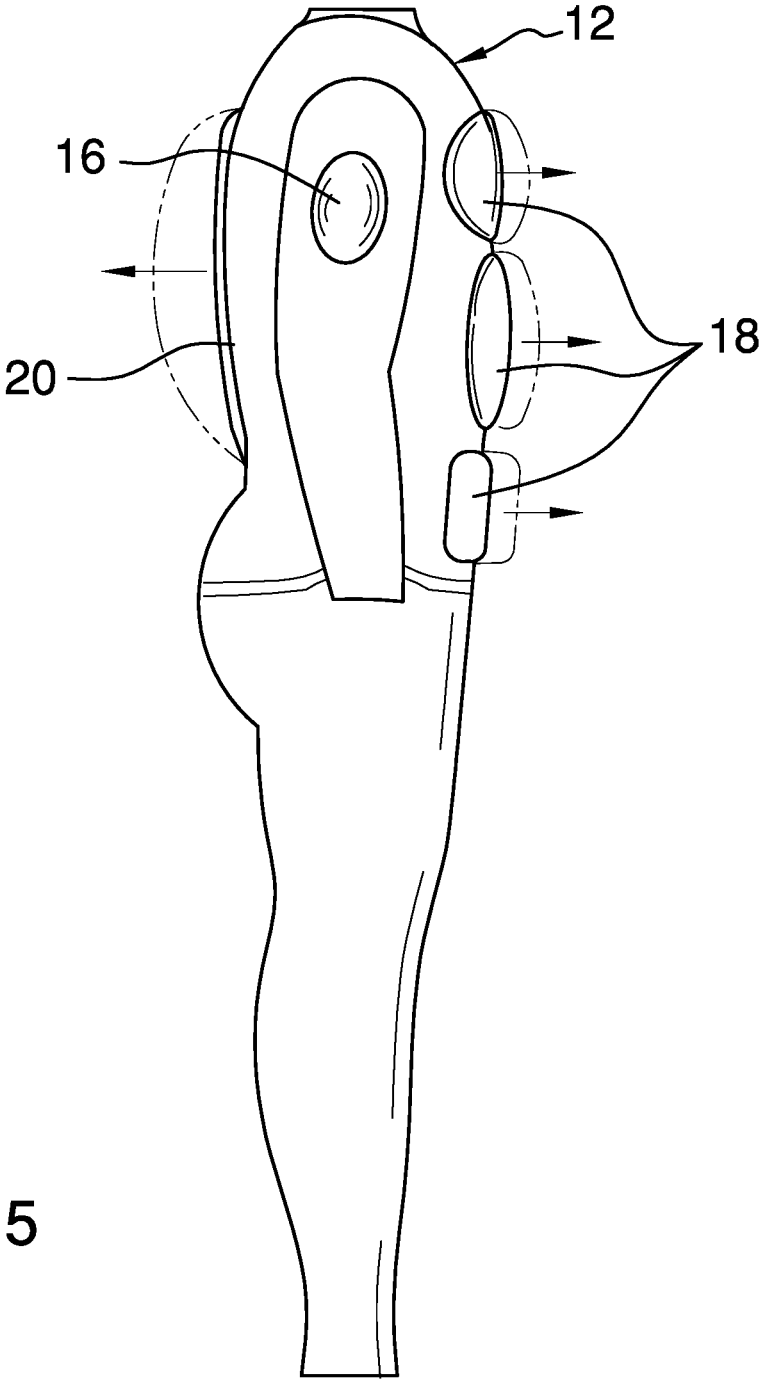
FIG. 5 is a side view of an embodiment of the disclosure.
Figure 6:
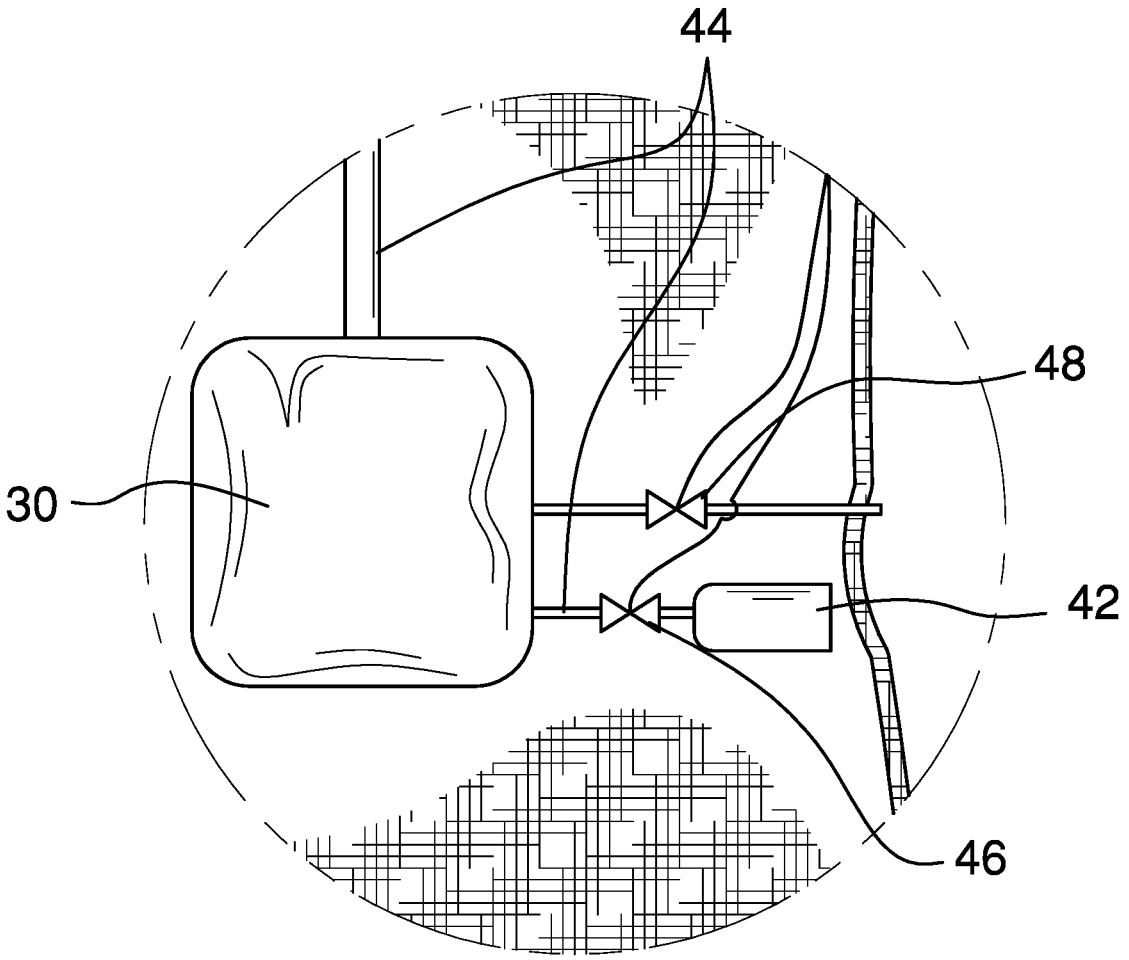
FIG. 6 is a cross-sectional view of an embodiment of the disclosure.

Each arm bladder 16 is positioned on a respective sleeve 22 of the wetsuit 12 so that the arm bladder 16 is proximate to a shoulder of a user who is positioned in the wetsuit 12, as shown in FIG. 5. The plurality of front bladders 18 is positioned on a front torso area 24 of the wetsuit 12 so that the plurality of front bladders 18 is positioned proximate to a chest and an abdomen of the user who is positioned in the wetsuit 12, as shown in FIG. 2. The plurality of rear bladders 20 is positioned on a rear torso area 26 of the wetsuit 12 so that the plurality of rear bladders 20 is positioned proximate to a back of the user who is positioned in the wetsuit 12, as shown in FIG. 3. The plurality of rear bladders 20 comprises one rear bladder 20.

The plurality of front bladders 18 comprises an upper bladder 28, a lower bladder 30, and a medial bladder 32. The upper bladder 28 is positioned on the front torso area 24 so that the upper bladder 28 is proximate to the chest of the user who is positioned in the wetsuit 12. The lower bladder 30 is positioned on the front torso area 24 so that the lower bladder 30 is proximate to a waist of the user who is positioned in the wetsuit 12. The medial bladder 32 is positioned on the front torso area 24 between the upper bladder 28 and the lower bladder 30.

The arm bladders 16 and the rear bladder 20 are ovally shaped. The upper bladder 28 is lemniscately shaped. The lower bladder 30 is squarely shaped. The medial bladder 32 is circularly shaped.

A zipper 34 is positioned in the rear torso area 26 of the wetsuit 12. The zipper 34 extends from a neckline 36 to proximate to a waistline 38 of the wetsuit 12. The zipper 34 is configured to be opened to allow a user to don the wetsuit 12.

An inflation unit 40 is fluidically coupled to the plurality of bladders 14. The inflation unit 40 comprises a compressed air cylinder 42. A tube 44 is coupled to and extends between the inflation unit 40 and the plurality of bladders 14 so that each bladder 14 is in fluidic communication with the inflation unit 40. A fill valve 46 is positioned in the tube 44 between the inflation unit 40 and the plurality of bladders 14. A release valve 48 is coupled to the plurality of bladders 14.

A receiver 50, a transmitter 52, and a controller 54 are coupled to the wetsuit 12. The receiver 50 is global position system enabled. The controller 54 is operationally coupled to the inflation unit 40, the receiver 50, and the transmitter 52. The controller 54 is positioned to selectively actuate the inflation unit 40 to inflate the bladders 14 to increase a buoyancy of the user. The controller 54 is positioned to selectively actuate the receiver 50 to receive location coordinates and the transmitter 52 to transmit the location coordinates and a distress signal.

The controller 54 is positioned on a respective sleeve 22 of the wetsuit 12 so that the controller 54 is positioned on a forearm of the user who is positioned in the wetsuit 12.

The controller 54 comprises a housing 56 that defines an interior space 58. A power module 60, and a microprocessor 62 are coupled to the housing 56 and are positioned in the interior space 58. The power module 60 comprises a battery 64. The microprocessor 62 is operationally coupled to the power module 60, the receiver 50, the transmitter 52, the fill valve 46, and the release valve 48. A first button 66, a second button 68, and a third button 70 are coupled to the housing 56. The first button 66, the second button 68, and the third button 70 are depressible. The first button 66, the second button 68, and the third button 70 are operationally coupled to the microprocessor 62.

The first button 66 is configured to be depressed to signal the microprocessor 62 to actuate the fill valve 46 to inflate the bladders 14. The second button 68 is configured to be depressed to signal the microprocessor 62 to actuate the release valve 48 to deflate the bladders 14. The third button 70 is configured to be depressed to signal the microprocessor 62 to actuate the receiver 50 to receive the location coordinates and the transmitter 52 to transmit the location coordinates and the distress signal.

In use, the user dons the wetsuit 12. In an emergency underwater situation where the user needs to surface, the user depresses the first button 66 to signal the microprocessor 62 to actuate the fill valve 46 to inflate the bladders 14. If the user requires assistance from rescue personnel, the user depresses the third button 70 to signal the microprocessor 62 to actuate the receiver 50 to receive the location coordinates and the transmitter 52 to transmit the location coordinates and the distress signal.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. An environmental protection garment comprising:

a wetsuit;

a plurality of bladders coupled to said wetsuit;

an inflation unit coupled to said wetsuit, said inflation unit being fluidically coupled to said plurality of bladders;

a receiver coupled to said wetsuit, said receiver being global positioning system enabled;

a transmitter coupled to said wetsuit;

a controller coupled to said wetsuit, said controller being operationally coupled to said inflation unit, said receiver, and said transmitter wherein said controller is positioned for selectively actuating said inflation unit for inflating said bladders for increasing a buoyancy of a user, wherein said controller is positioned for selectively actuating said receiver for receiving location coordinates and said transmitter for transmitting the location coordinates and a distress signal;

a tube coupled to and extending between said inflation unit and said plurality of bladders such that each said bladder is in fluidic communication with said inflation unit;

a fill valve positioned in said tube between said inflation unit and said plurality of bladders;

a release valve coupled to said plurality of bladders; and said controller comprising:

a housing defining an interior space, a power module coupled to said housing and positioned in said interior space, a microprocessor coupled to said housing and positioned in said interior space, said microprocessor being operationally coupled to said power module, said receiver, said transmitter, said fill valve, and said release valve, a first button coupled to said housing, said first button being depressible, said first button being operationally coupled to said microprocessor wherein said first button is configured for depressing for signaling said microprocessor for actuating said fill valve for inflating said bladders, a second button coupled to said housing, said second button being depressible, said second button being operationally coupled to said microprocessor wherein said second button is configured for depressing for signaling said microprocessor for actuating said release valve for deflating said bladders, and a third button coupled to said housing, said third button being depressible, said third button being operationally coupled to said microprocessor wherein said third button is configured for depressing for signaling said microprocessor for actuating said receiver for receiving the location coordinates and said transmitter for transmitting the location coordinates and the distress signal.

2. The garment of claim 1, further including said plurality of bladders comprising:

a pair of arm bladders, each said arm bladder being positioned on a respective sleeve of said wetsuit such that said arm bladder is proximate to a shoulder of the user positioned in said wetsuit;

a plurality of front bladders positioned on a front torso area of said wetsuit such that said plurality of front bladders are positioned proximate to a chest and an abdomen of the user positioned in said wetsuit; and a plurality of rear bladders positioned on a rear torso area of said wetsuit such that said plurality of rear bladders are positioned proximate to a back of the user positioned in said wetsuit.

3. The garment of claim 2, further including comprising:

said plurality of front bladders comprising:

an upper bladder positioned on said front torso area such that said upper bladder is proximate to the chest of the user positioned in said wetsuit, a lower bladder positioned on said front torso area such that said lower bladder is proximate to a waist of the user positioned in said wetsuit, and a medial bladder positioned on said front torso area between said upper bladder and said lower bladder; and said plurality of rear bladders comprising one said rear bladder.

4. The garment of claim 1, further including a zipper positioned in a rear torso area of said wetsuit, said zipper extending from a neckline to proximate to a waistline of said wetsuit wherein said zipper is configured for opening for allowing the user to don said wetsuit.

5. The garment of claim 1, further including said inflation unit comprising a compressed air cylinder.

6. The garment of claim 1, further including said controller being positioned on a respective said sleeve such that said controller is positioned on a forearm of the user positioned in said wetsuit.

7. The garment of claim 1, further including said power module comprising a battery.

8. An environmental protection garment comprising:

a wetsuit;

a plurality of bladders coupled to said wetsuit;

an inflation unit coupled to said wetsuit, said inflation unit being fluidically coupled to said plurality of bladders;

a receiver coupled to said wetsuit, said receiver being global positioning system enabled;

a transmitter coupled to said wetsuit; and a controller coupled to said wetsuit, said controller being operationally coupled to said inflation unit, said receiver, and said transmitter wherein said controller is positioned for selectively actuating said inflation unit for inflating said bladders for increasing a buoyancy of a user, wherein said controller is positioned for selectively actuating said receiver for receiving location coordinates and said transmitter for transmitting the location coordinates and a distress signal;

said plurality of bladders comprising a pair of arm bladders, each said arm bladder being positioned on a respective sleeve of said wetsuit such that said arm bladder is proximate to a shoulder of the user positioned in said wetsuit;

a plurality of front bladders positioned on a front torso area of said wetsuit such that said plurality of front bladders are positioned proximate to a chest and an abdomen of the user positioned in said wetsuit;

a plurality of rear bladders positioned on a rear torso area of said wetsuit such that said plurality of rear bladders are positioned proximate to a back of the user positioned in said wetsuit;

said plurality of front bladders comprising an upper bladder positioned on said front torso area such that said upper bladder is proximate to the chest of the user positioned in said wetsuit, a lower bladder positioned on said front torso area such that said lower bladder is proximate to a waist of the user positioned in said wetsuit, and a medial bladder positioned on said front torso area between said upper bladder and said lower bladder; and said plurality of rear bladders comprising one said rear bladder;

said arm bladders being ovally shaped;

said upper bladder being lemniscately shaped;

said lower bladder being squarely shaped;

said medial bladder being circularly shaped; and said rear bladder being ovally shaped.

9. An environmental protection garment comprising:

a wetsuit;

a plurality of bladders coupled to said wetsuit, said plurality of bladder comprising:

a pair of arm bladders, each said arm bladder being positioned on a respective sleeve of said wetsuit such that said arm bladder is proximate to a shoulder of a user positioned in said wetsuit, said arm bladders being ovally shaped, a plurality of front bladders positioned on a front torso area of said wetsuit such that said plurality of front bladders are positioned proximate to a chest and an abdomen of the user positioned in said wetsuit, said plurality of front bladders comprising:

an upper bladder positioned on said front torso area such that said upper bladder is proximate to the chest of the user positioned in said wetsuit, said upper bladder being lemniscately shaped, a lower bladder positioned on said front torso area such that said lower bladder is proximate to a waist of the user positioned in said wetsuit, said lower bladder being squarely shaped, and a medial bladder positioned on said front torso area between said upper bladder and said lower bladder, said medial bladder being circularly shaped, and a plurality of rear bladders positioned on a rear torso area of said wetsuit such that said plurality of rear bladders are positioned proximate to a back of the user positioned in said wetsuit, said plurality of rear bladders comprising one said rear bladder, said rear bladder being ovally shaped;

a zipper positioned in said rear torso area of said wetsuit, said zipper extending from a neckline to proximate to a waistline of said wetsuit wherein said zipper is configured for opening for allowing the user to don said wetsuit;

an inflation unit coupled to said wetsuit, said inflation unit being fluidically coupled to said plurality of bladders, said inflation unit comprising a compressed air cylinder;

a tube coupled to and extending between said inflation unit and said plurality of bladders such that each said bladder is in fluidic communication with said inflation unit;

a fill valve positioned in said tube between said inflation unit and said plurality of bladders;

a release valve coupled to said plurality of bladders;

a receiver coupled to said wetsuit, said receiver being global positioning system enabled;

a transmitter coupled to said wetsuit; and a controller coupled to said wetsuit, said controller being operationally coupled to said inflation unit, said receiver, and said transmitter wherein said controller is positioned for selectively actuating said inflation unit for inflating said bladders for increasing a buoyancy of the user, wherein said controller is positioned for selectively actuating said receiver for receiving location coordinates and said transmitter for transmitting the location coordinates and a distress signal, said controller being positioned on a respective said sleeve such that said controller is positioned on a forearm of the user positioned in said wetsuit, said controller comprising:

a housing defining an interior space, a power module coupled to said housing and positioned in said interior space, said power module comprising a battery, a microprocessor coupled to said housing and positioned in said interior space, said microprocessor being operationally coupled to said power module, said receiver, said transmitter, said fill valve, and said release valve, a first button coupled to said housing, said first button being depressible, said first button being operationally coupled to said microprocessor wherein said first button is configured for depressing for signaling said microprocessor for actuating said fill valve for inflating said bladders, a second button coupled to said housing, said second button being depressible, said second button being operationally coupled to said microprocessor wherein said second button is configured for depressing for signaling said microprocessor for actuating said release valve for deflating said bladders, and a third button coupled to said housing, said third button being depressible, said third button being operationally coupled to said microprocessor wherein said third button is configured for depressing for signaling said microprocessor for actuating said receiver for receiving the location coordinates and said transmitter for transmitting the location coordinates and the distress signal.

* * * * *